US010655295B2

(12) United States Patent
Sprout et al.

(10) Patent No.: US 10,655,295 B2
(45) Date of Patent: May 19, 2020

(54) CLAMPING ADAPTER AND METHODS FOR SONIC PILE DRIVING

(71) Applicant: Terra Sonic International, LLC, Marietta, OH (US)

(72) Inventors: Edwin Sprout, Walker, WV (US); James Savinkoff, Reno, OH (US)

(73) Assignee: Terra Sonic International, LLC, Marietta, OH (US)

( * ) Notice: Subject to any disclaimer, the term of this patent is extended or adjusted under 35 U.S.C. 154(b) by 0 days.

(21) Appl. No.: 16/349,721

(22) PCT Filed: Jan. 5, 2018

(86) PCT No.: PCT/US2018/012523
§ 371 (c)(1),
(2) Date: May 14, 2019

(87) PCT Pub. No.: WO2018/129278
PCT Pub. Date: Jul. 12, 2018

(65) Prior Publication Data

US 2019/0323194 A1 Oct. 24, 2019

Related U.S. Application Data

(60) Provisional application No. 62/442,589, filed on Jan. 5, 2017.

(51) Int. Cl.
*E02D 13/10* (2006.01)
*B06B 1/18* (2006.01)
(Continued)

(52) U.S. Cl.
CPC ..... *E02D 13/10* (2013.01); *B06B 1/18* (2013.01); *B06B 3/00* (2013.01); *E02D 7/18* (2013.01); *E02D 9/02* (2013.01); *E02D 11/00* (2013.01)

(58) Field of Classification Search
CPC .. E02D 13/10; E02D 7/18; B06B 1/18; B06B 3/00
(Continued)

(56) References Cited

U.S. PATENT DOCUMENTS 3,227,483 A * 1/1966 Guild ..... E02D 13/10 294/195
3,530,947 A * 9/1970 Gendron ..... E02D 1/04 175/55
(Continued)

FOREIGN PATENT DOCUMENTS

CN 105569558 A 5/2016
FR 2656044 A1 6/1991

OTHER PUBLICATIONS

International Searching Authority, Search Report and Written Opinion issued in International Application No. PCT/US18/12523 dated Mar. 9, 2018 (10 pages).

*Primary Examiner* — Tara Mayo-Pinnock
(74) *Attorney, Agent, or Firm* — Wood Herron & Evans LLP

(57) ABSTRACT

A pile driving adapter includes an upper attachment portion for selectively attaching the adapter to a drill head and a lower housing portion including at least a first outer wall. The pile driving adapter further includes at least one actuator including a first portion slidably mounted to the lower housing portion and a second portion configured to expand from the first portion in a direction perpendicular to the first outer wall. The first portion may be slidably mounted to the lower housing portion via a sliding mount, and the lower housing portion may include at least one elongate slot for receiving at least a portion of the sliding mount. The pile driving adapter advantageously couples the drill head and the member to be driven so as to reliably transfer sonic energy.

26 Claims, 7 Drawing Sheets

(51) Int. Cl.

| | |
|---|---|
| ***B06B 3/00*** | (2006.01) |
| ***E02D 7/18*** | (2006.01) |
| *E02D 9/02* | (2006.01) |
| *E02D 11/00* | (2006.01) |

(58) Field of Classification Search
USPC ..... 405/232, 255; 24/537; 173/90, 92, 165; 279/2.1; 294/2.09, 93, 195
See application file for complete search history.

(56) References Cited

U.S. PATENT DOCUMENTS

| | | | | |
|---|---|---|---|---|
| 3,537,536 | A * | 11/1970 | Cordes et al. | E02D 7/10 173/92 |
| 4,100,974 | A * | 7/1978 | Pepe | E02D 7/18 173/49 |
| 4,102,409 | A | 7/1978 | Lagerstedt | |
| 4,621,688 | A | 11/1986 | Bodine | |
| 8,186,452 | B1 * | 5/2012 | White | E02D 5/30 173/1 |
| 2005/0155758 | A1 | 7/2005 | Webb et al. | |

* cited by examiner

CLAMPING ADAPTER AND METHODS FOR SONIC PILE DRIVING

CROSS-REFERENCE TO RELATED APPLICATION

This application is a national phase application of, and claims priority to, International Application No. PCT/US2018/012523, filed Jan. 5, 2018, the disclosure of which is incorporated by reference herein in its entirety.

This application claims the benefit of U.S. Provisional Patent Application Ser. No. 62/442,589, filed Jan. 5, 2017, the disclosure of which is incorporated by reference herein in its entirety.

TECHNICAL FIELD

This application relates generally to pile driving systems and methods. More specifically, this application describes mechanisms and methods for adapting a sonic drill head to a member that is to be driven in a pile driving application.

BACKGROUND

Pile drivers are mechanical devices used to drive piles, poles, I-beams, or other members into the ground or other surfaces to provide foundation support for buildings or other structures. Although pile drivers are well-established, it is always desirable to improve the speed and reliability of the equipment used. Thus, a recent innovation finding more use in the field is vibration-enhanced pile driving equipment. One example is a sonic pile driver.

Vibratory or sonic pile drivers include a sonic drill head which may be lifted and positioned over the member by a drill rig mast, excavator or crane, and then fastened to the member using threading or flanging, for example. Such pile drivers may be designed to generate mechanical oscillating forces wherein horizontal vibrations cancel out, while vertical vibrations (e.g., those most effective at improving pile driving speed and reliability) are transmitted into the member. These vibrations may be used to either drive in or extract the member, and the vibration rates may range from about 0 Hz to about 150 Hz (vibration cycles per second). To effectively and efficiently transmit the vibrations from the sonic drill head to the member, the coupling between the sonic drill head and member should be tight and secure. However, existing sonic drill heads are not optimally designed to form such a tight and secure coupling. As a result, the fastening of a sonic drill head to a member may result in poor transfer of oscillating force, or even slippage between the sonic drill head and the member.

Thus, it would be desirable to provide systems and methods to provide improved coupling of a sonic drill head to a member to transfer oscillating force thereto in a more efficient manner, thereby to improve effectiveness of all sonic pile driving applications.

SUMMARY

In one embodiment, a pile driving adapter includes an upper attachment portion for selectively attaching the adapter to a drill head (using threaded engagement, flange connections, or other similar attachment means) and a lower housing portion including a first outer wall. The pile driving adapter further includes at least one actuator including a first portion slidably mounted to the lower housing portion and a second portion configured to expand from the first portion in a direction perpendicular to the first outer wall. The first portion may be slidably mounted to the lower housing portion via a sliding mount, and the lower housing portion may include at least one elongate slot for receiving at least a portion of the sliding mount. The first and second portions may include a cylinder and a piston, respectively. The adapter is configured to transfer sonic energy between the drill head and the member to be driven.

In another embodiment, a method of coupling a drill head to a member is provided, with the member including a first wall. The method includes selectively attaching the drill head to an upper attachment portion of an adapter using threaded engagement, flange connections, or another similar attachment mechanism. The adapter includes a lower housing portion having a first outer wall and further includes at least one actuator having a first portion slidably mounted to the lower housing portion and further having a second portion configured to expand from the first portion in a direction perpendicular to the first outer wall. The method also includes positioning the adapter over the member such that the first wall is received between the second portion and the first outer wall. The method further includes activating the at least one actuator such that the second portion expands away from the first portion toward the first wall and clamps the first wall against the first outer wall.

In another embodiment, a method of pile driving a member is provided, with the member including a first wall. The method includes selectively attaching the drill head to an upper attachment portion of an adapter using threaded engagement, flange connections, or another similar attachment mechanism. The adapter includes a lower housing portion having a first outer wall and further includes at least one actuator having a first portion slidably mounted to the lower housing portion and further having a second portion configured to expand from the first portion in a direction perpendicular to the first outer wall. The method also includes positioning the adapter over the member such that the first wall is received between the second portion and the first outer wall. The method further includes activating the at least one actuator such that the second portion expands away from the first portion toward the first wall and clamps the first wall against the first outer wall. The method also includes transferring energy such as sonic energy from the drill head to the member via the adapter.

BRIEF DESCRIPTION OF THE DRAWINGS

Various additional features and advantages of the invention will become more apparent to those of ordinary skill in the art upon review of the following detailed description of one or more illustrative embodiments taken in conjunction with the accompanying drawings. The accompanying drawings, which are incorporated in and constitute a part of this specification, illustrate one or more embodiments of the invention and, together with the general description given above and the detailed description given below, serve to explain the one or more embodiments of the invention.

DETAILED DESCRIPTION

With reference to FIGS. 1-3C, a sonic pile driving adapter 10 is shown in accordance with one embodiment. As set forth in further detail below, the adapter 10 may be coupled to a sonic drill head 12 and clamped over a member 14 to form a secure and tight connection between the drill head 12 and the member 14. The sonic drill head 12 may then be activated to generate an oscillating force, which may be effectively and efficiently transferred to the member 14 via the adapter 10 without slippage between the member 14 and the adapter 10 and/or drill head 12 for pile driving in and/or extracting the member 14. The features of the adapter 10 are set forth in further detail below to clarify each of these functional advantages and other benefits provided in this disclosure, which are applicable to pile driving and potentially other technical applications of this arrangement.

Figure 1:
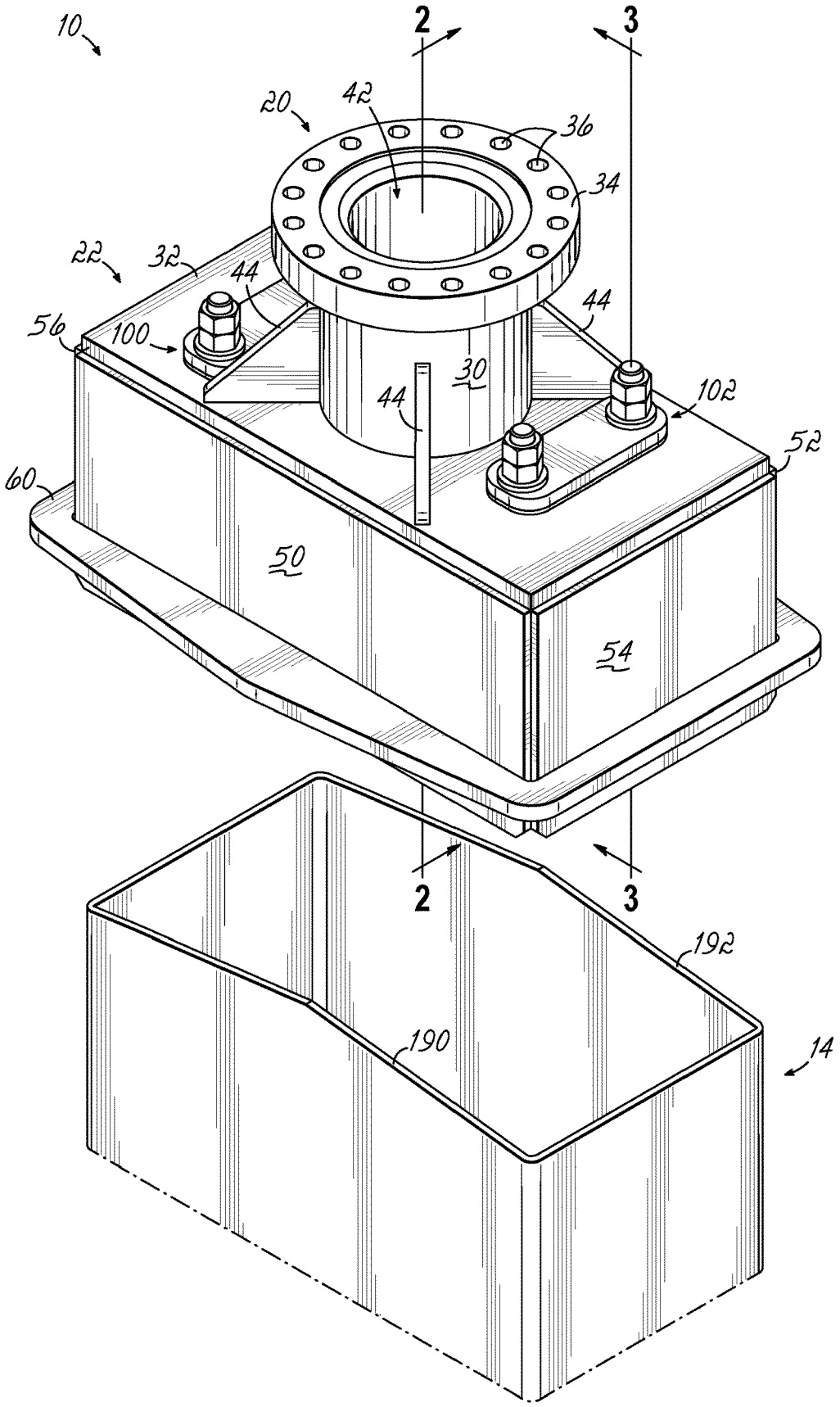
FIG. 1 is a perspective view of an exemplary sonic pile driving adapter in accordance with one embodiment of the invention.
Figure 3:
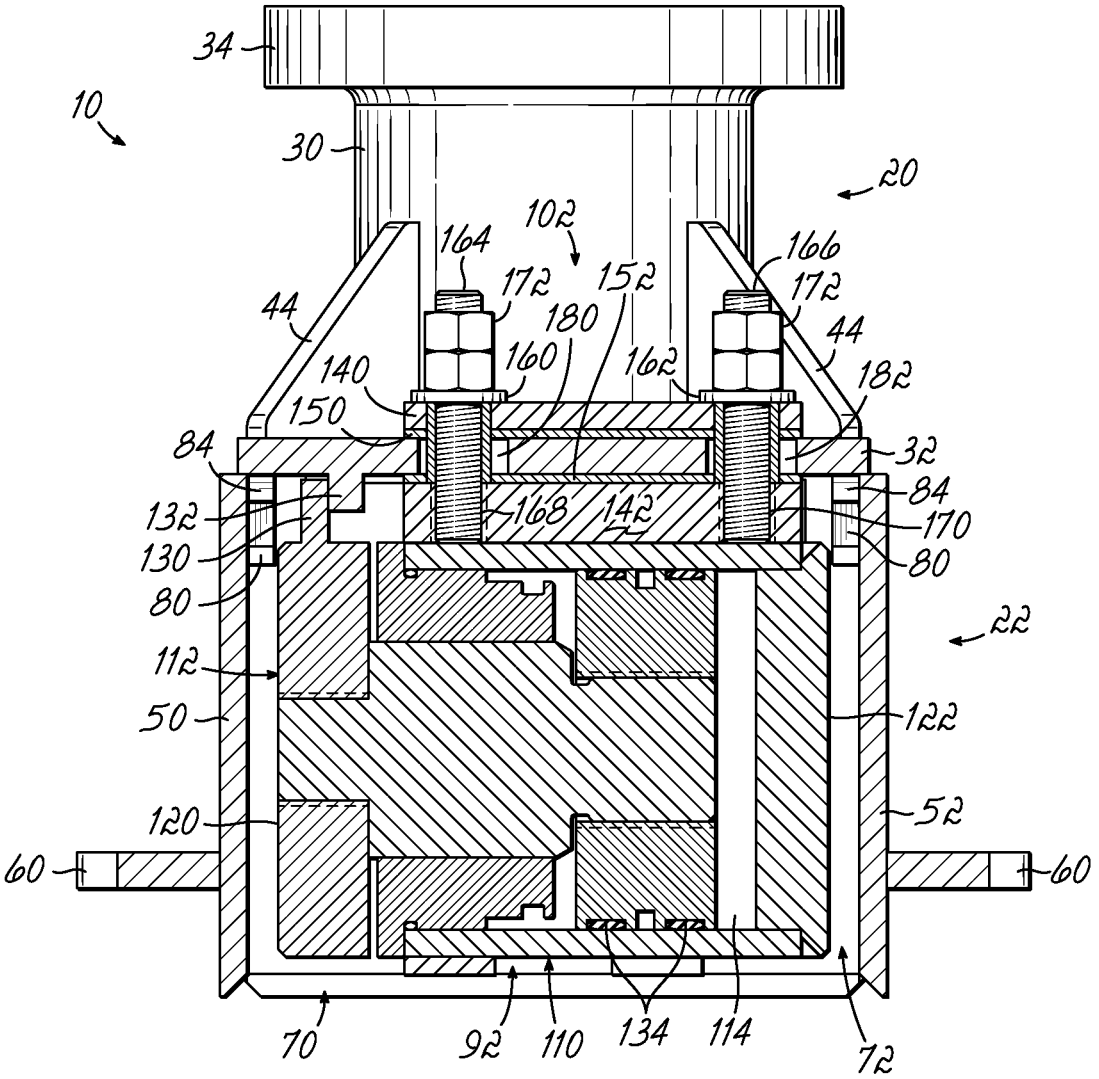
FIG. 3 is a cross sectional side view of the sonic pile driving adapter of FIG. 1, taken along line 3-3 in FIG. 1.
Figure 3A:
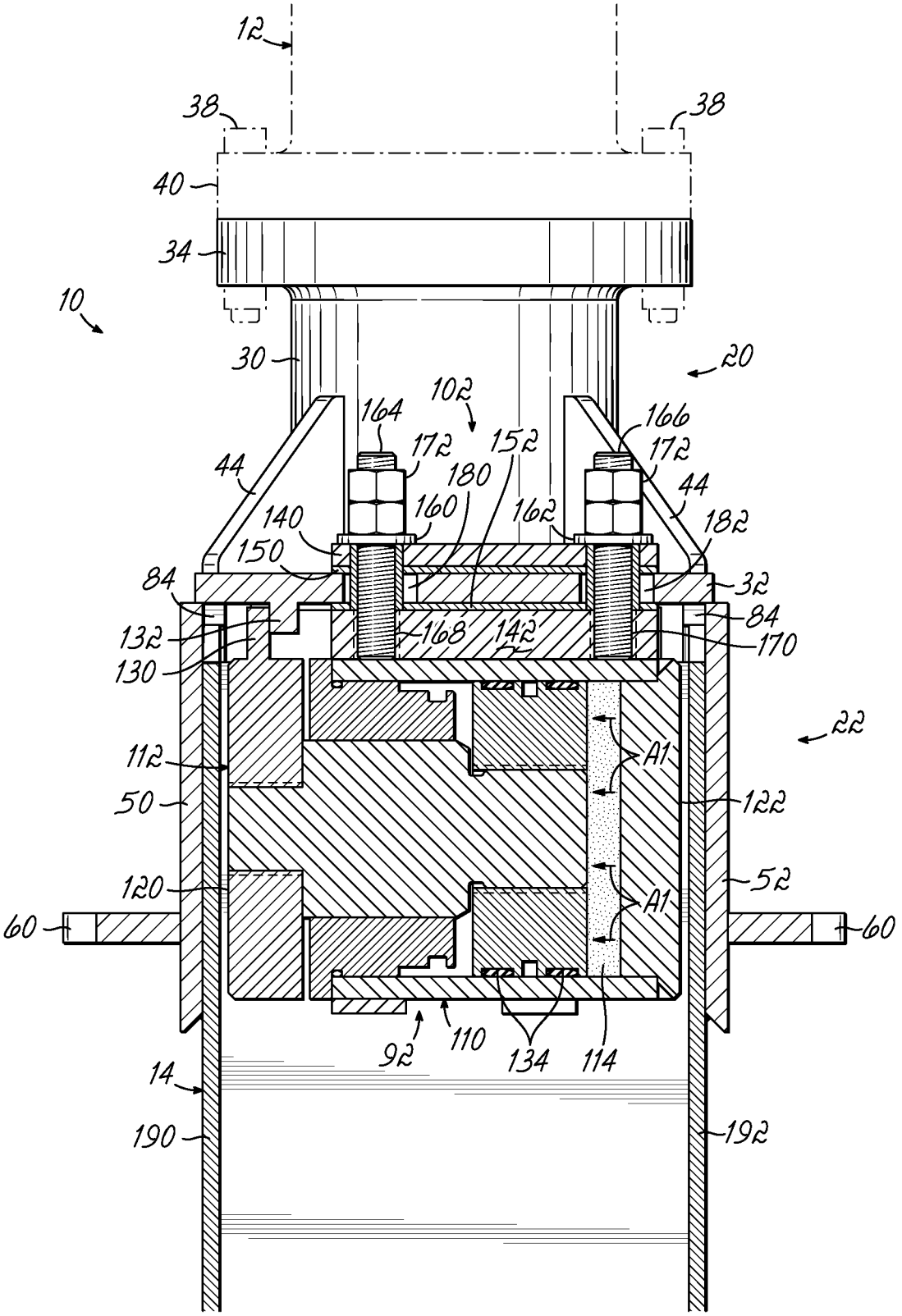
FIG. 3A is a cross sectional side view similar to FIG. 3, showing the sonic pile driving adapter coupled to a sonic drill head (shown in phantom) and positioned over a member to be pile driven, and in a first stage of actuation.

As shown in FIG. 1, the adapter 10 includes an upper attachment portion 20 and a lower housing portion 22. The attachment portion 20 is configured for selectively attaching the adapter 10 to a sonic drill head 12 (FIG. 3A). For example, the attachment portion 20 includes a cylindrical wall 30 rigidly coupled to an upper wall 32 of the housing portion 22 and terminating at a circular flange 34. A plurality of through holes 36 are provided in the circular flange 34 for receiving bolts 38 to rigidly couple the circular flange 34 to a corresponding flange 40 of the sonic drill head 12 (FIG. 3A). The cylindrical wall 30 defines a passageway 42 which may receive a corresponding shaft (not shown) of the sonic drill head 12 to provide improved stability between the sonic drill head 12 and the adapter 10. A plurality of reinforcing members 44 is provided between the cylindrical wall 30 and the upper wall 32 to provide increased rigidity to the adapter 10. As described in further detail below, this is simply one option for coupling to the drill head 12, and other arrangements are possible within the scope of the invention.

Figure 2:
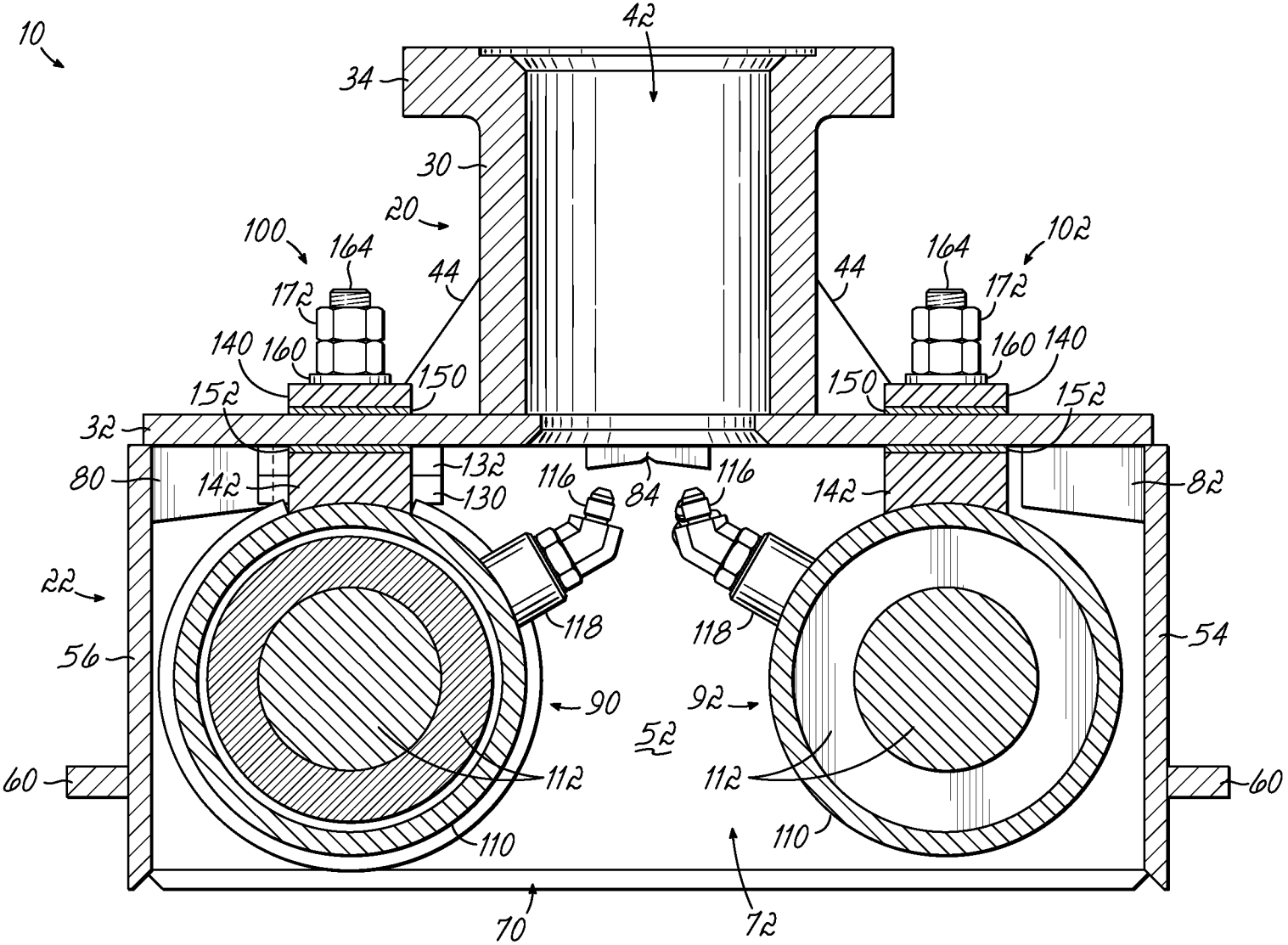
FIG. 2 is a cross sectional front view of the sonic pile driving adapter of FIG. 1, taken along line 2-2 in FIG. 1.

The housing portion 22 is made to fit the dimensions of the member to be pile driven whether said member is a pile, pole, I-beam, column or another member. Therefore, in the illustrated example embodiment, the housing portion 22 includes first, second, third, and fourth outer walls 50, 52, 54, 56 extending downwardly from the periphery of the upper wall 32, to match the generally rectangular shape of the member 14 to be driven shown in FIG. 1. At least one peripheral flange 60 surrounding the outer walls 50, 52, 54, 56 provides increased rigidity to the outer walls 50, 52, 54, 56 and/or maintains the shape of the housing portion 22. As shown in FIGS. 2 and 3, the housing portion 22 defines an opening 70 which provides access to an interior space 72 of the housing portion 22 delineated by the outer walls 50, 52, 54, 56. The interior space 72 is sized to receive an upper portion of the member 14 inserted therein via the opening 70. Various stop plates, such as first and second corner stop plates 80, 82 and a middle stop plate 84, are attached to the upper wall 32 and/or any of the outer walls 50, 52, 54, 56 to limit the insertion of the member 14 to a predetermined/desired position, as discussed in greater detail below. The stop plates 80, 82, 84 are shaped to complement a profile of the upper portion of the member 14. For example, the stop plates 80, 82, 84 are each angled to complement an upper portion of a member 14 having an angled profile such as a triangular profile. Likewise, it will be understood that a different shape and/or number of outer walls on a housing portion can be used in other embodiments to work with different members than the example shown in the drawings. For example, the housing portion 22 may be reconfigured to clamp only against a single wall or outer surface when the member to be pile driven is an I-beam (e.g., it may not include a series of outer walls as in the illustrated embodiment).

First and second hydraulic actuators 90, 92 are slidably mounted to the lower housing portion 22 in the interior space 72 via first and second sliding mounts 100, 102, respectively, and thus are at least partially surrounded by the outer walls 50, 52, 54, 56, while providing clearance between the actuators 90, 92 and the outer walls 50, 52, 54, 56 to receive the upper portion of a member 14. The sliding mounts 100, 102 advantageously enable the reliable clamp action of the adapter 10 on the member 14, and these elements are described in further detail below.

Each actuator 90, 92 includes a cylinder 110 and a piston 112 configured to expand from the cylinder 110 in a direction substantially perpendicular to at least one of the first and second outer walls 50, 52 when the actuator 90, 92 is activated. For example, each piston 112 expands from the respective cylinder 110 when a chamber 114 of the actuator 90, 92 is pressurized, such as by supplying a hydraulic fluid to the chamber 114 via an input nozzle 116 and/or input port 118, as is known. To that end, hoses may fluidly couple the input nozzles 116 to a hydraulic fluid reservoir (not shown), and may extend through the passageway 42. Likewise, the pistons 112 are each retracted into the respective cylinder 110 when the chamber 114 is depressurized, such as by at least partially removing the hydraulic fluid from the chamber 114. Each piston 112 includes an abutment surface 120 opposite the respective cylinder 110, and each cylinder 110 includes an abutment surface 122 opposite the respective piston 112. A rod stop 130 provided on the piston 112 abuts a corresponding rod stop 132 provided on the housing portion 22 to limit the retraction of the piston 112 into the respective cylinder 110 to a predetermined/desired position. One or more O-rings 134 are provided between each piston 112 and the respective cylinder 110 to provide a fluid tight seal therebetween. In the embodiment shown, the first and second actuators 90, 92 are oriented in opposite directions, such that the pistons 112 expand in opposite directions. Alternatively, the first and second actuators 90, 92 may be oriented in the same general direction, such that the pistons 112 may expand in the same general direction.

Each cylinder 110 is slidably mounted to the upper wall 32 of the housing portion 22 by the respective sliding mount 100, 102. As best shown in FIG. 3, each sliding mount 100, 102 includes upper and lower retainer plates 140, 142 disposed on opposite sides of the upper wall 32 to sandwich the upper wall 32 therebetween. The lower retainer plate 142 is rigidly coupled to an outer surface of the cylinder 110 such as by, for example, welding the lower retainer plate 142 to the cylinder 110 or integrally forming the lower retainer plate 142 together with the cylinder 110 as a unitary piece. In any event, upper and lower slide bearing plates 150, 152 are provided between the upper wall 32 and the upper and lower retainer plates 140, 142, respectively, to decrease any frictional forces between the sliding mount 100, 102 and the upper wall 32. For example, the upper and lower slide bearing plates 150, 152 may be constructed of a relatively low friction or self-lubricating material, such as a plastic. In one embodiment, the upper retainer plate 140 and upper slide bearing plate 150 may be integrally formed together as a unitary piece, and the lower retainer plate 142 and lower slide bearing plate 152 may be integrally formed together as a unitary piece. As shown, first and second flanged bushings 160, 162 extend through the upper retainer plate 140, upper slide bearing plate 150, upper wall 32, and lower slide bearing plate 152 for receiving first and second threaded studs 164, 166, whose lower portions are screwed into corresponding threaded holes 168, 170 in the lower retainer plate 142. At least one threaded nut 172 is screwed onto the upper portion of each threaded stud 164, 166 to securely retain the sliding mount 100, 102 on the upper wall 32. Alternatively, the flanged bushings 160, 162 may be replaced by solid sleeve bushings, and one or more washers may be provided between the at least one threaded nut 172 and the upper retainer plate 140.

As shown, the first and second flanged bushings 160, 162, and thus the first and second threaded studs 164, 166, pass through the upper wall 32 via first and second elongate slots 180, 182, respectively. The elongate slots 180, 182 are sized and shaped to receive the first and second threaded studs 164, 166 to shift laterally therein between a first position (FIG. 3A) and a second position (FIG. 3C) such that a portion of the sliding mount 102 is received in and may slide a limited amount with respect to the housing portion 22 (the cylinder 110 also slides along with the mount 102). For example, the elongate slots 180, 182 extend in a direction substantially parallel to the direction in which the corresponding piston 112 expands and retracts, such that the sliding of the cylinder 110 and the expansion and/or retraction of the piston 112 occur in the same direction. For example, the elongate slots 180, 182 extend in a direction substantially perpendicular to at least one of the first and second outer walls 50, 52.

Figure 3B:
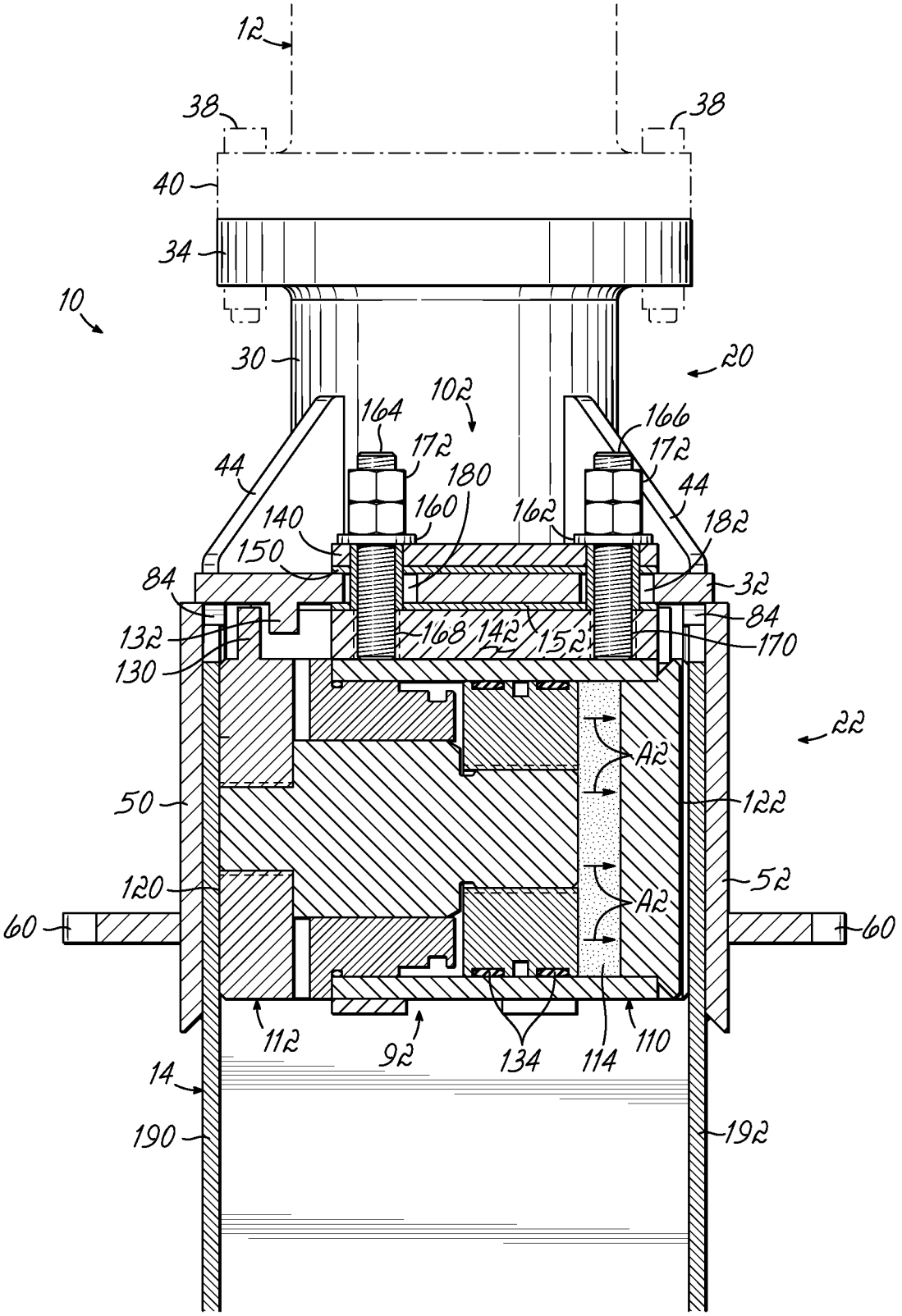
FIG. 3B is a cross sectional side view similar to FIG. 3A, showing the sonic pile driving adapter in a second stage of actuation.
Figure 3C:
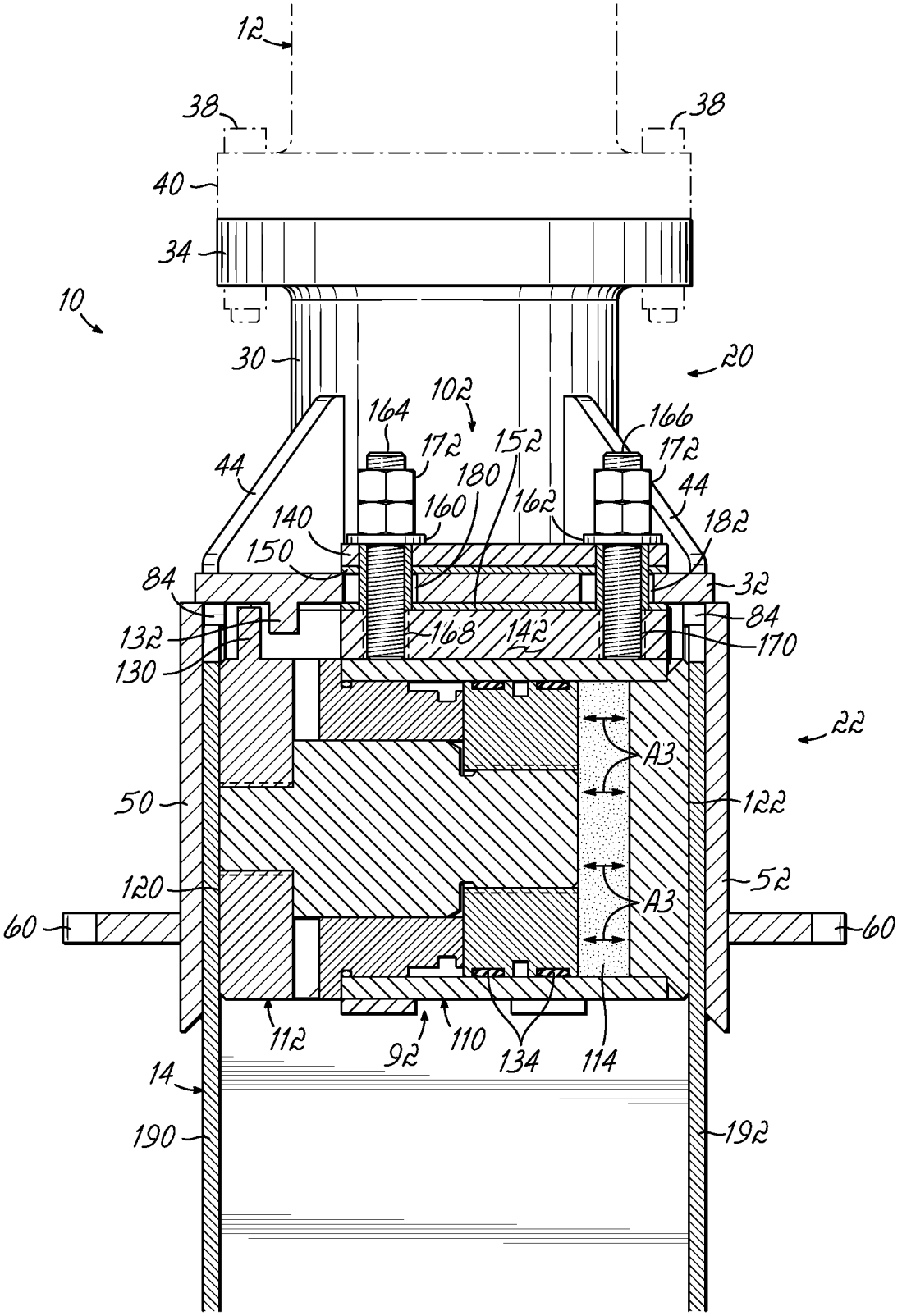
FIG. 3C is a cross sectional side view similar to FIG. 3B, showing the sonic pile driving adapter in a third stage of actuation.

With specific reference now to FIGS. 3A-3C, the sonic pile driving adapter 10 is coupled to a sonic drill head 12 and positioned over a member 14 having at least first and second walls 190, 192. In particular, the sonic drill head 12 is coupled to the attachment portion 20 as previously discussed. The first and second walls 190, 192 are inserted into the interior space 72 of the housing portion 22 between the actuators 90, 92 and the first and second outer walls 50, 52, respectively. As shown, the first and second walls 190, 192 are in contact with or in close proximity with the first and second outer walls 50, 52, respectively. For example, the first and second outer walls 50, 52 are spaced apart to provide a close fit between themselves and the first and second walls 190, 192 of the member 14, respectively. The close fit may be a clearance fit, a location fit, and/or a transition fit. The first and second walls 190, 192 are inserted until they contact the corresponding stop plates 80, 82, 84, which indicate that the member 14 is fully inserted and is properly aligned for clamping action.

With the member 14 fully inserted into the housing portion 22, hydraulic fluid is supplied to the chamber 114 of each actuator 90, 92, thereby pressurizing the chamber 114 and exerting a force on the piston 112 in the direction of the arrows A1, as shown in FIG. 3A. This force causes the piston 112 to expand from the cylinder 110 until the abutment surface 120 of the piston 112 abuts the first wall 190 of the member 14 and presses the first wall 190 firmly against the first outer wall 50 of the housing portion 22, as shown in FIG. 3B. Thus, the first wall 190 is sandwiched or clamped between the piston 112 and the first outer wall 50, and the piston 112 is prevented from further outward movement. As hydraulic fluid continues to be supplied to the chamber 114, the pressure in the chamber 114 exerts a force on the cylinder 110 in the direction of the arrows A2. This force causes the cylinder 110 to expand from the piston 112 until the abutment surface 122 of the cylinder 110 abuts the second wall 192 of the member 14 and presses the second wall 192 firmly against the second outer wall 52 of the housing portion 22, as shown in FIG. 3C. Thus, the second wall 192 is sandwiched or clamped between the cylinder 110 and the second outer wall 52, and the cylinder 110 is prevented from further outward movement. In the embodiment shown, the movement of the cylinder 110 relative to the housing portion 22 is accommodated by the sliding mount 102 in conjunction with the elongate slots 180, 182 in the upper wall 32. In particular, the elongate slots 180, 182 allow the sliding mount 102 to laterally be movable from the first position to the second position as the pressurization of the chamber 114 urges the cylinder 110 away from the piston 112, until the abutment surface 122 abuts the second wall 192. The chamber 114 may remain pressurized during operation of the sonic drill head 12 to maintain the reliable clamping of the first and second walls 190, 192 of the member 14 by the adapter 10, as indicated by the arrows A3.

While the piston 112 has been described in the embodiment above as expanding toward the first wall 190 prior to the cylinder 110 expanding toward the second wall 192, it will be appreciated that the piston 112 and cylinder 110 may expand away from each other and toward the respective walls 190, 192 simultaneously, or the cylinder 110 may expand toward the second wall 192 prior to the piston 112 expanding toward the first wall 190, without departing from the scope of this invention. For example, frictional forces between the sliding mount 102 and the upper wall 32 may impact the order of expansion. In any event, the first and second walls 190, 192 are ultimately clamped by the piston 112 and cylinder 110, respectively, and the corresponding outer wall 50, 52, to thereby reliably couple the sonic drill head 12 and the member 14 with the adapter 10, and in such a manner that sonic energy can be transferred from the sonic drill head 12 into the member 14.

It will be appreciated that hydraulic fluid may be provided to the chamber 114 of each actuator 90, 92 via a valve and/or control system (not shown) located at or near ground level, such that the actuators 90, 92 may be activated by personnel at or near ground level. Thus, the clamping of the member 14 by the adapter 10 may be performed without requiring personnel to manually adjust the adapter 10 at a position high above the ground, as members 14 such as piles are typically of significant height.

As shown in FIG. 3C, the clamping of the member 14 by the adapter 10 is tight and secure. In particular, the piston 112 and cylinder 110, in conjunction with the respective outer wall 50, 52, may each exert a consistent pressure evenly distributed over a substantial surface area of the respective wall 190, 192 of the member 14. To that end, the actuators 90, 92 may each be positioned inward of the opening 70 such that substantially all the surface area of the abutment surfaces 120, 122 may face the respective outer wall 50, 52, to prevent lower portions of the outer walls 50, 52 and/or walls 190, 192 from bowing outwardly during expansion of the piston 112 and/or cylinder 110. In addition, or alternatively, the close fit between the walls 190, 192 of the member 14 and the outer walls 50, 52 of the housing portion 22 may allow the piston 112 and/or cylinder 110 to sandwich the walls 190, 192 of the member 14 without substantially bending the walls 190, 192 or creating uneven pressure or stress points in the walls 190, 192.

In the embodiment shown, the stop plates 80, 82, 84 limit the insertion of the member 14 to a predetermined position, whereat the uppermost portions of the first and second walls 190, 192 are above the corresponding abutment surface 120, 122, such that substantially all the surface area of the abutment surface 120, 122 may contact the respective wall 190, 192. In addition, or alternatively, the abutment of the walls 190, 192 of the member 14 against corresponding stop plates 80, 82, 84 may contribute to the tight and secure clamping by preventing the uppermost portions of the member 14 from moving freely during operation of the sonic drill head 12. In the embodiment shown, the peripheral flange 60 provides increased rigidity to the first and second outer walls 50, 52 to prevent the outer walls 50, 52 and/or walls 190, 192 from substantially flexing outwardly under the force(s) exerted by the piston 112 and/or cylinder 110.

By providing a tight and secure clamping of the member 14 by the adapter 10, the connection between the sonic drill head 12 and the member 14 via the adapter 10 is substantially rigid. This may prevent slippage of the member 14 relative to the adapter 10 and/or sonic drill head 12 during operation of the sonic drill head 12, and provide an effective and efficient transfer of oscillating forces—from the drill head 12 to the member 14. In one embodiment, various components of the adapter 10 such as, for example, the attachment portion 20, upper wall 32, first and second outer walls 50, 52, cylinders 110, and pistons 112, are constructed of a material having a strength and/or durability capable of transferring oscillating forces typical in sonic drilling applications from the drill head 12 to the member 14. For example, various components of the adapter 10 may be constructed of steel.

To remove the adapter 10 from the member 14, such as after operation of the sonic drill head 12 to drive in or extract the member 14, at least a portion of the hydraulic fluid may be removed from the chamber 114 to thereby depressurize the chamber 114 and allow the piston 112 and cylinder 110 to be retracted from the respective walls 190, 192 and unclamp the member 14. In the embodiment shown, the piston 112 may be retracted until the rod stop 130 of the piston 112 abuts the rod stop 132 of the housing portion 22. In one embodiment, the abutment of the rod stops 130, 132 may assist in retracting the cylinder 110 from the second wall 192. In any event, when the piston 112 and cylinder 110 have been sufficiently retracted from the respective walls 190, 192, the adapter 10 may be lifted away from the member 14, such as via the sonic drill head 12, and stored or mounted to another member for continued operation, for example.

While first and second actuators 90, 92 slidably mounted to the housing portion 22 via first and second sliding mounts 100, 102 are shown in the illustrated embodiment, any number of actuators and corresponding sliding mounts may be used depending on the application. For example, one, three, or four actuators and a corresponding number of sliding mounts may be used in other embodiments. It will be understood that actuators other than hydraulic actuators 90, 92 may also be used in other embodiments consistent with the invention. For example, linear actuators such as pneumatic actuators or screw-type actuators may replace the hydraulic actuators 90, 92 shown in the illustrated embodiment. In one embodiment using a screw-type actuator, a lead tube may be coupled to a sliding mount 100, 102 in a manner similar to the cylinder 110, and a lead screw may expand therefrom and retract therein, in place of the piston 112, to provide the advantageous functionality in the pile driving context as set forth above.

Various sonic pile driving adapters 10 may be configured to accommodate members 14 of different sizes and shapes, such that a single sonic drill head 12 may be coupled to a variety of members 14 to effectively and efficiently transfer oscillating forces thereto. Thus, it will be appreciated that various features of the illustrated adapter 10 may be modified to accommodate a particular member 14. In particular, the spacing of the first outer wall 50 relative to the second outer wall 52 may be increased or decreased depending on the spacing of the first and second walls 190, 192 of a member. Likewise, the shapes and configurations of the stop plates 80, 82, 84 may be modified depending on the particular features of a member 14, such as a profile of the upper portion of the member 14.

Figure 4:
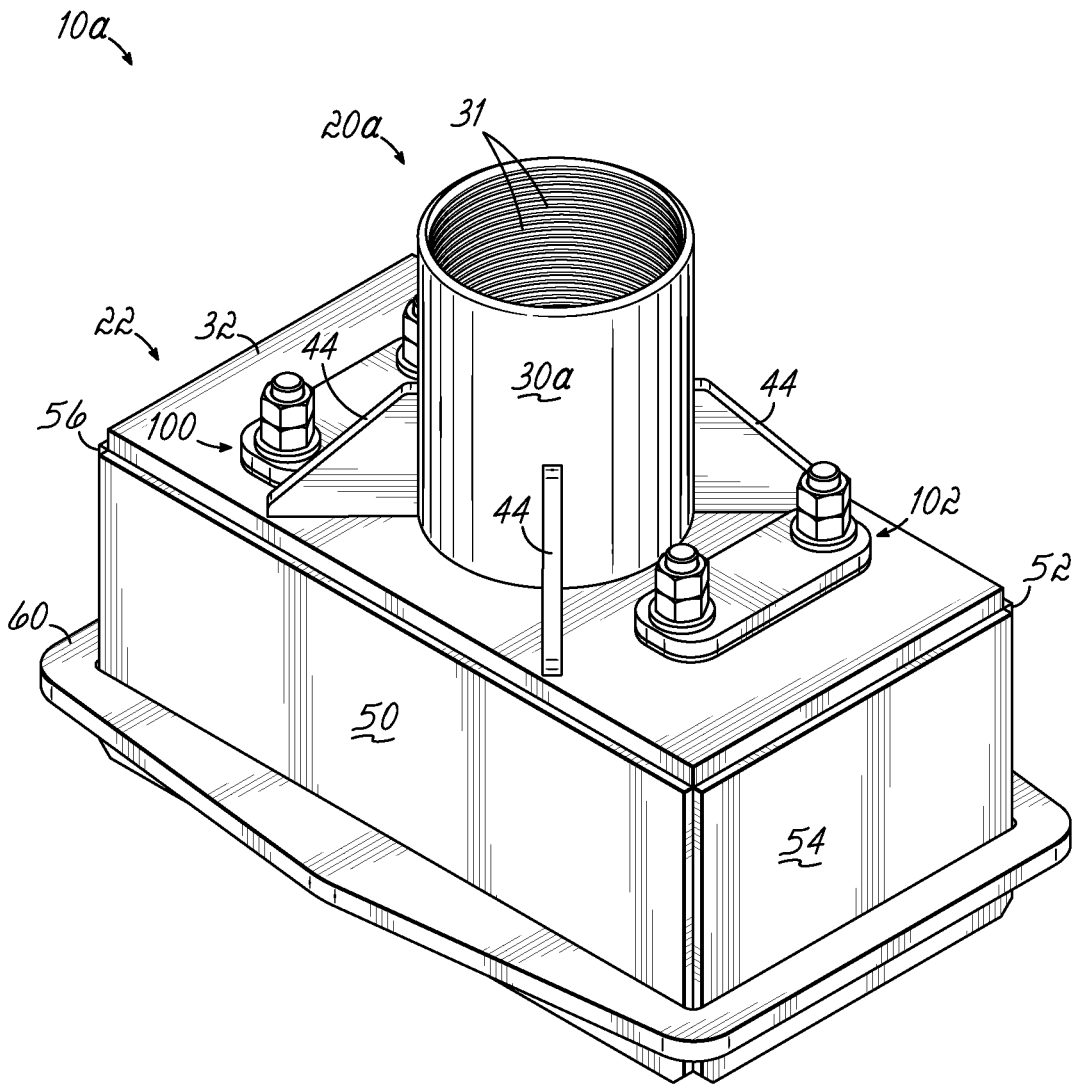
FIG. 4 is a perspective view of an exemplary sonic pile driving adapter in accordance with another embodiment.

With reference now to FIG. 4, wherein like numerals represent like features, in an alternative embodiment, a sonic pile driving adapter 10*a* includes an alternative attachment portion 20*a* mounted to a housing portion 22 as previously described. The attachment portion 20*a* is configured for selectively attaching the adapter 10*a* to a sonic drill head. In this embodiment, the attachment portion 20*a* includes a cylindrical wall 30*a* rigidly coupled to an upper wall 32 of the housing portion 22 and including a plurality of threads 31 on an internal surface thereof. The cylindrical wall 30*a* and/or threads 31 are configured to mate with a corresponding threaded spindle of a sonic drill head (not shown) to rigidly couple the adapter 10*a* to the sonic drill head. A plurality of reinforcing members 44 is provided between the cylindrical wall 30*a* and the upper wall 32 to provide increased rigidity to the adapter 10. It will be appreciated that the threaded spindle of the sonic drill head may be automatically screwed into the cylindrical wall 30*a* of the attachment portion 20*a* via one or more actuators and/or control systems, as is known. Likewise, although examples of flanged connections and threaded engagement have been shown in the drawing Figures, other types of known attachment mechanisms may be provided in other embodiments of the invention as readily understood in the art for connecting the upper attachment portion with the drill head. The details of the housing portion 22 and its contents are substantially the same as those previously described and are not repeated for the sake of brevity. For example, the housing portion 22 may include four outer walls for clamping to a rectangular member to be pile driven, or a different number of outer wall(s) based on different designs of members to be driven. Thus, the adapter 10*a* of this embodiment continues to provide the advantageous functionality in the pile driving context as set forth above.

While the present invention has been illustrated by the description of various embodiments thereof, and while the embodiments have been described in considerable detail, it is not intended to restrict or in any way limit the scope of the appended claims to such detail. Thus, the various features discussed herein may be used alone or in any combination. Additional advantages and modifications will readily appear to those skilled in the art. The invention in its broader aspects is therefore not limited to the specific details and illustrative examples shown and described. Accordingly, departures may be made from such details without departing from the scope of the general inventive concept.

What is claimed is:

1. A pile driving adapter for connecting a drill head to a member to be pile driven, comprising:

an upper attachment portion for selectively attaching the adapter to a drill head;

a lower housing portion including a first outer wall; and at least one actuator including a first portion slidably mounted to the lower housing portion and a second portion configured to expand from the first portion in a direction perpendicular to the first outer wall, wherein when a member to be pile driven is received in the lower housing portion and the at least one actuator activates, the second portion expands away from the first portion and clamps into contacting engagement with a first wall of the member to hold the first wall in position against the first outer wall.

2. The pile driving adapter of claim 1, wherein the lower housing portion also includes a second outer wall, and the second portion of the at least one actuator is configured to expand from the first portion in a direction perpendicular to the first and second outer walls.

3. The pile driving adapter of claim 2, wherein the first portion is configured to slide with respect to the lower housing portion in a direction perpendicular to at least one of the first and second outer walls.

4. The pile driving adapter of claim 3, wherein the first portion is slidably mounted to the lower housing portion via a sliding mount, and wherein the lower housing portion includes at least one elongate slot for receiving at least a portion of the sliding mount.

5. The pile driving adapter of claim 4, wherein the portion of the sliding mount received by the elongate slot is movable between a first position in the elongate slot and a second position in the elongate slot.

6. The pile driving adapter of claim 4, wherein the sliding mount includes at least one slide bearing plate.

7. The pile driving adapter of claim 2, wherein the first and second outer walls are spaced apart from each other to provide at least one of a clearance fit, a location fit, or a transition fit over a member.

8. The pile driving adapter of claim 1, wherein the at least one actuator includes at least two actuators oriented in different directions.

9. The pile driving adapter of claim 1, wherein the lower housing portion includes at least one stop plate for limiting insertion of a member into the lower housing portion to a predetermined position.

10. The pile driving adapter of claim 1, wherein the first portion includes a cylinder, and the second portion includes a piston that is configured to retract into the cylinder in a direction perpendicular to the first outer wall.

11. The pile driving adapter of claim 1, wherein the lower housing portion and the at least one actuator are configured to couple a member to a drill head in such a manner to allow transfer of sonic energy from the drill head into the member during pile driving.

12. The pile driving adapter of claim 1, wherein the upper attachment portion is connected to a drill head by at least one of threaded engagement and a flange connection.

13. A method of coupling a drill head to a member, the member including a first wall, the method comprising:

selectively attaching the drill head to an upper attachment portion of an adapter, the adapter including a lower housing portion having a first outer wall and further including at least one actuator having a first portion slidably mounted to the lower housing portion and further having a second portion configured to expand from the first portion in a direction perpendicular to the first outer wall;

positioning the adapter over the member such that the first wall is received between the second portion and the first outer wall; and activating the at least one actuator such that the second portion expands away from the first portion toward the first wall and clamps the first wall against the first outer wall.

14. The method of claim 13, wherein the member includes a second wall, the lower housing portion of the adapter includes a second outer wall, positioning the adapter over the member further includes causing the second wall to be received between the first portion and the second outer wall, and activating the at least one actuator further causes the first portion to expand away from the second portion towards the second wall and clamps the second wall against the second outer wall.

15. The method of claim 14, wherein the first portion slides with respect to the lower housing portion when the first portion expands away from the second portion toward the second wall.

16. The method of claim 15, wherein the first portion is slidably mounted to the lower housing portion via a sliding mount, and wherein the lower housing portion includes at least one elongate slot for receiving at least a portion of the sliding mount that moves from a first position in the elongate slot to a second position in the elongate slot when the first portion expands away from the second portion toward the second wall.

17. The method of claim 13, wherein the lower housing portion includes at least one stop plate for limiting insertion of a member into the lower housing portion to a predetermined position, and wherein positioning the adapter over the member includes engaging the stop plate with the member.

18. The method of claim 13, wherein the at least one actuator includes at least one hydraulic actuator, and wherein activating the at least one hydraulic actuator includes supplying pressurized fluid to at least one chamber of the at least one hydraulic actuator.

19. The method of claim 13, further comprising:

transferring sonic energy from the drill head to the member via the adapter.

20. The method of claim 13, wherein the upper attachment portion is selectively attached to the drill head by at least one of threaded engagement and a flange connection.

21. A method of pile driving a member, the member including a first wall, the method comprising:

selectively attaching a drill head to an upper attachment portion of an adapter, the adapter including a lower housing portion having a first outer wall and further including at least one actuator having a first portion slidably mounted to the lower housing portion and further having a second portion configured to expand from the first portion in a direction perpendicular to the first outer wall;

positioning the adapter over the member such that the first wall is received between the second portion and the first outer wall;

activating the at least one actuator such that the second portion expands away from the first portion toward the first wall and clamps the first wall against the first outer wall; and transferring energy from the drill head to the member via the adapter.

22. The method of claim 21, wherein transferring energy from the drill head to the member via the adapter includes transferring sonic energy.

23. The method of claim 21, wherein the at least one actuator includes at least one hydraulic actuator, and wherein activating the at least one hydraulic actuator includes supplying pressurized fluid to at least one chamber of the at least one hydraulic actuator.

24. The method of claim 21, further comprising:

retracting at least one of the first portion and the second portion toward the other of the first portion and the second portion; and lifting the adapter away from the member.

25. The method of claim 21, wherein the member includes a second wall, the lower housing portion of the adapter includes a second outer wall, positioning the adapter over the member further includes causing the second wall to be received between the first portion and the second outer wall, and activating the at least one actuator further causes the first portion to expand away from the second portion towards the second wall and clamps the second wall against the second outer wall.

26. The method of claim 21, wherein the upper attachment portion is selectively attached to the drill head by at least one of threaded engagement and a flange connection.

* * * * *